United States Patent [19]

Machal

[11] Patent Number: 4,881,622

[45] Date of Patent: Nov. 21, 1989

[54] SAFETY GRAB PROTECTION DEVICE

[76] Inventor: Henry Machal, 380 Elkwood Ter., Englewood, N.J. 07631

[21] Appl. No.: 162,679

[22] Filed: Mar. 1, 1988

[51] Int. Cl.[4] ..... B65H 59/16

[52] U.S. Cl. ..... 188/65.1; 24/134 P; 182/5

[58] Field of Search ..... 188/65.1–65.5; 24/134; 182/5–7, 189; 114/218; 254/391, 389, 415

[56] References Cited

U.S. PATENT DOCUMENTS

| | | | |
|---|---|---|---|
| 1,362,905 | 12/1920 | Vanderdonck | 24/134 P |
| 1,434,802 | 11/1922 | Bear | 24/134 R |
| 1,926,975 | 9/1933 | Endsor | 24/134 L |
| 1,959,722 | 5/1934 | Lackner | 24/134 P |
| 3,179,994 | 4/1965 | Meyer et al. | 24/134 R |
| 3,793,682 | 2/1974 | Nelson | 24/134 P |
| 3,852,943 | 12/1974 | Healy | 24/134 R |
| 4,140,207 | 2/1979 | Sharp et al. | 188/65.1 |
| 4,144,620 | 3/1979 | Schaeffer | 24/71.3 |
| 4,253,218 | 3/1981 | Gibbs | 24/134 R |
| 4,278,042 | 7/1981 | Lindquist | 188/65.2 X |
| 4,560,029 | 12/1985 | Dalmaso | 182/5 |
| 4,580,658 | 4/1986 | Brda | 182/5 |

FOREIGN PATENT DOCUMENTS

| | | | |
|---|---|---|---|
| 3531391 | 3/1987 | Fed. Rep. of Germany | 182/5 |

*Primary Examiner*—Douglas C. Butler

*Attorney, Agent, or Firm*—Hopgood, Calimafde, Kalil, Blaustein & Judlowe

[57] ABSTRACT

A safety grab protection device that both operates bi-directionally for connecting a safety belt lanyard to a vertical safety rope and has contoured cam surfaces that engage the safety rope in such a way that the shape of the braking surfaces engage the rope without damaging it.

9 Claims, 2 Drawing Sheets

SAFETY GRAB PROTECTION DEVICE

BACKGROUND AND SUMMARY OF THE INVENTION

The present invention relates to an improved safety grab protection device and, more particularly, a device that does not damage or cut the safety rope during braking and works in whichever direction it is attached on the rope.

There are a variety of safety clamps and connectors used in the scaffolding and other related industries. Each of these devices for one reason or another is in some way inferior to the present invention.

For example, Meyer (U.S. Pat. No. 3,179,994), Healy (U.S. Pat. No. 3,852,943) and Gibbs (U.S. Pat. No. 4,253,218) all disclose safety devices that contain a single cam braking arm. These devices work in only one direction and if attached to the safety rope in the wrong, upside-down, position the cam will not stop or protect against a fall. Dalmaso (U.S. Pat No. 4,560,029) has a double cam safety action but it suffers from the same problems as Meyer, Healy and Gibbs since it works in only one direction.

Gripping devices such as Vanderdonck (U.S. Pat. No. 1,362,905), Bear (U.S. Pat. No. 1,434,802), Endsor (U.S. Pat. No. 1,926,975), Lackner (U.S. Pat. No. 1,959,722) and Sharp (U.S. Pat. No. 4,140,207) appear to work in both directions have other serious flaws that make them potentially dangerous to the user. One significant problem that many of these devices suffer from is the fact that the brake cam is either tooth shaped or sharp edged which will damage the rope or even cut it when the brake cam is wedged against the safety line. Certain of these gripping designs are of such a configuration that they create the possibility that they may unexpectedly fall off the rope. Other cam levers are made of multiple parts including such parts as springs which can freeze during cold weather making them inoperable, and certain other devices will only work with one size of rope.

It is an object of the present invention to provide a safety grab protection device where the cam arms that come in contact with the rope will not damage the rope when the cam is wedged against the rope during braking and the device will also work no matter if it is attached in the up or down position to the safety rope.

It is a further object of the invention for the device to be attachable and detachable at any point on the life line. The invention further contemplates a safety device that will work on either $\frac{5}{8}$ inch or $\frac{3}{4}$ inch line.

The present invention provides a safety grab protection device operable bi-directionally for connecting a safety belt lanyard to a vertical safety rope or the like. The device comprises a clevis-like housing through which a safety rope can be reeved, a unitary brake cam for disposition between the ends of the clevis-like housing, the housing being apertured through its ends and the cam having a bore for alignment with the housing apertures, a removable pin for insertion through the apertures and the cam bore to pivotally join the cam to the housing. The cam also has arms extending to either side of the bore, normal to the axis of the bore so that arms are selectively articulable about the bore to pivot into apposition with the bight of the housing for alternative wedging of a rope against the bight and a rope engaging intaglio formation at the ends of the cam arms.

Other objects and advantages will become apparent from the following description taken in conjunction with the accompanying drawings.

DETAILED DESCRIPTION OF THE PREFERRED EMBODIMENT

Broadly considered, the present invention provides a safety grab protection device that operates bi-directionally when the cam arms have a rope engaging intaglio formation, the result being a device that will work even if installed in the upside-down position and due to the curved, knurled, safety rope contoured brake surfaces of the cam arms the device will not damage the rope but will provide a marrying type braking action.

Figure 1:
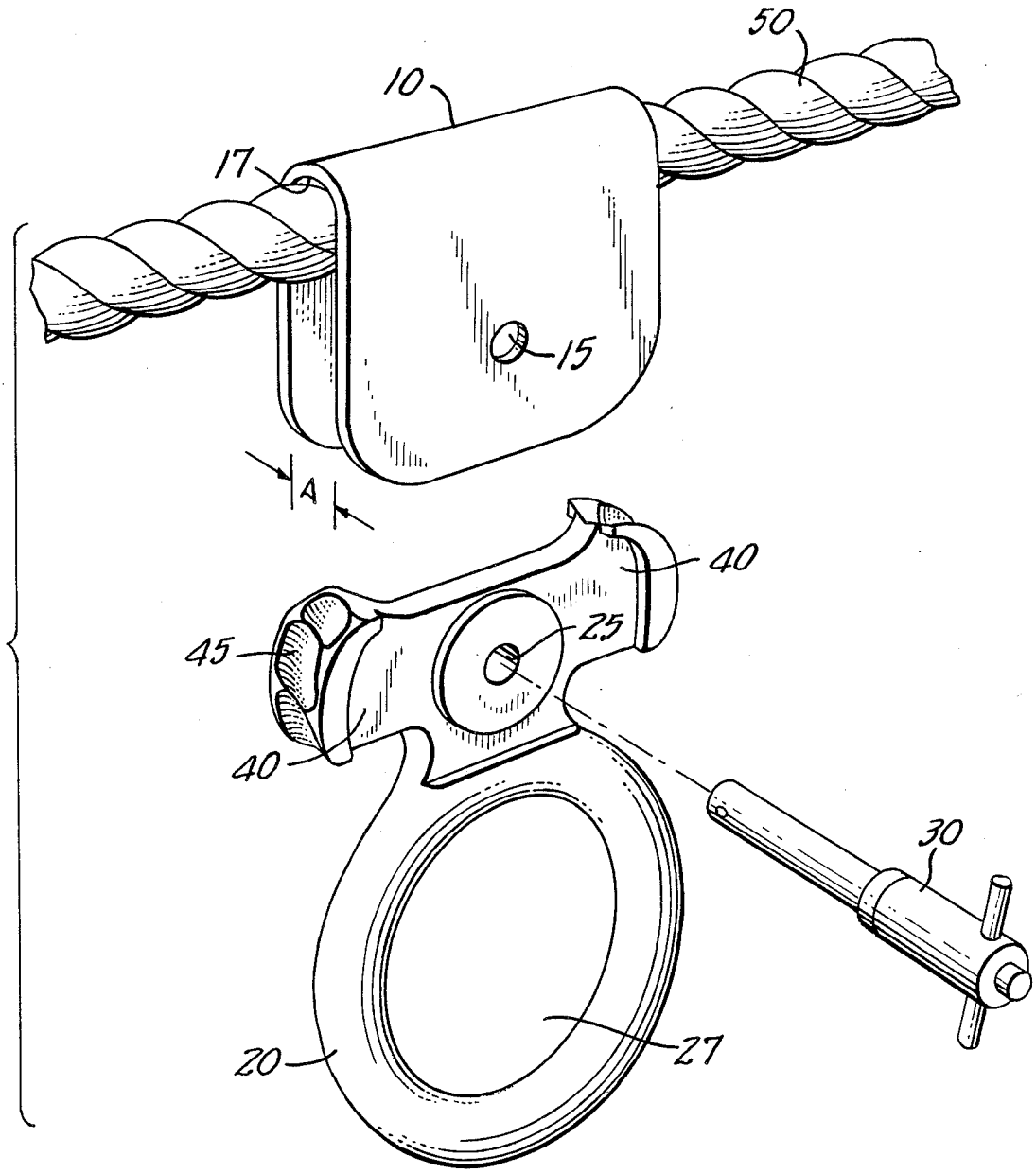
FIG. 1 is a perspective, exploded view of the safety grab protection device of the invention.

As seen in FIG. 1, the safety grab protection device of the invention comprises a clevis-like housing 10, a unitary brake cam 20 and a removable pin 30.

The clevis-like housing 10 must have a swallow width dimension A to allow a rope 17 to be reeved through it. In most cases this will mean a $\frac{5}{8}$ inch or $\frac{3}{4}$ inch rope. The housing must also have an aperture 15 through which a pin 30 can be inserted to connect the cam 20 to the housing 10.

Figure 2:
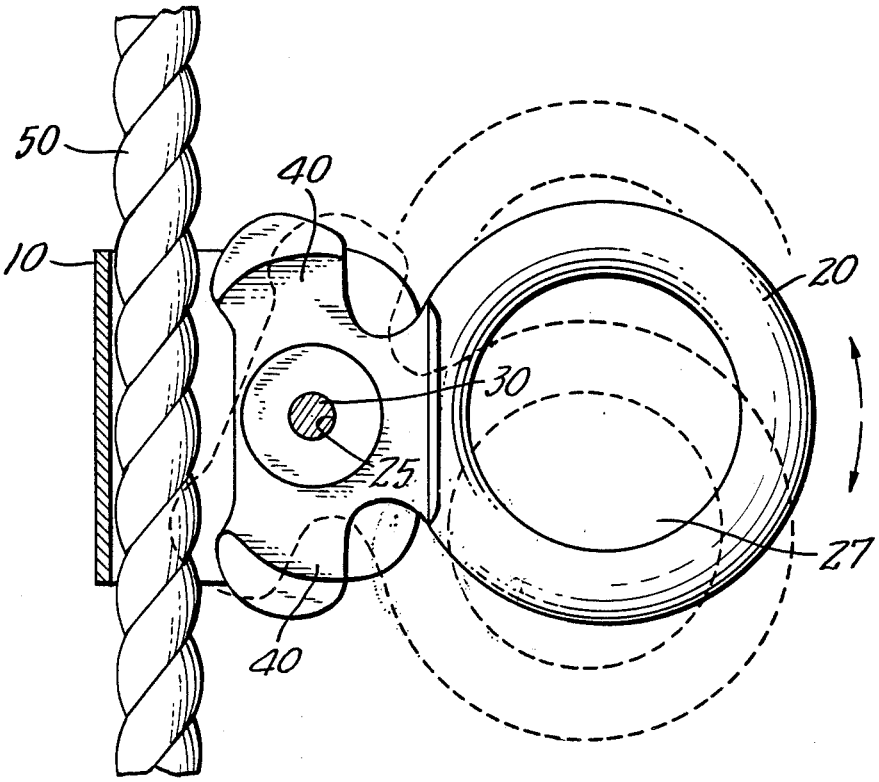
FIG. 2 is a cut away view of the safety grab protection device in FIG. 1 of the invention.

The unitary brake cam 20 has a through bore 25 which when aligned with the housing aperture 15 can be connected together by a pin 30. The pin connection allows bi-directional movement of the unitary brake cam 20, as shown in FIG. 2. FIGS. 1 and 2 also show that the brake cam 20 has an aperture 27 through which a workman's lanyard can be attached.

The brake cam 20 has arms 40 extending to either side of the bore 25, normal to the axis of the bore 25. The arms are selectively articulable about the bore and can pivot into apposition with the bight 17 of the housing 10 to wedge the rope 50 against the bight 17.

Each of the cam arms 40 have a surface configuration 45. This surface is a rope engaging intaglio formation. The rope 50 is an intertwined helix. The arm surfaces 45 are a curved, knurled, intaglio image of the safety rope's countour 50. Thus, when the arm surfaces 45 come in contact with safety rope 50 there is a marrying of the respective concave and convex portions of the two knurled surfaces.

FIG. 2 besides showing the bi-directional movement of the brake cam 20, also shows that the arms 40 are equidistant about the brake cam bore 25 to allow free movement of the safety rope 50 through the housing 10 when the cam 20 is in an unlocked position.

Figure 3:
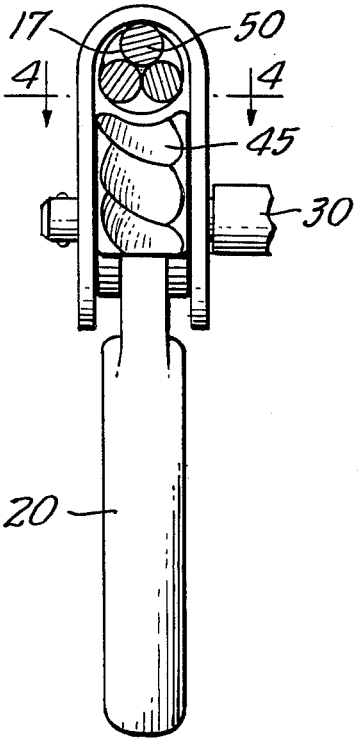
FIG. 3 is a plan view of the safety grab protection device of the invention.
Figure 4:
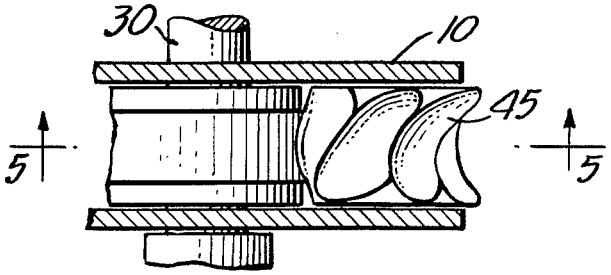
FIG. 4 is a cross sectional view of the safety grab Protection device of the invention taken along the line 4—4.

FIG. 3 also shows from a plan view that rope 50 will be able to move freely through the housing 10 when the cam 20 is in an unlocked position. FIGS. 3 and 4 accurately show the surface 45 of the cam arms 40 that form the curved, knurled intaglio image of the safety ropes contour 50. This surface 45 will not cut into the rope but will create a marrying type contact between the rope 50 and the cam arms 40 and more precisely the matching of the contours of the cam arm surfaces 45 and the rope contour. The contoured surface of the cam arms 45 act as a negative image of the helically shaped rope 50 providing a bonding or marrying of the peaks and valleys to create an extremely strong frictional alignment that prevents a sharp edge or surface from digging, pinching or cutting the rope. The cam arm surfaces 45 of the present invention prevent any damage occurring to the rope 50 by marrying the rope 50 and the cam surfaces 45 and then wedging the rope up against the bight 17 of the housing 10.

Figure 5:
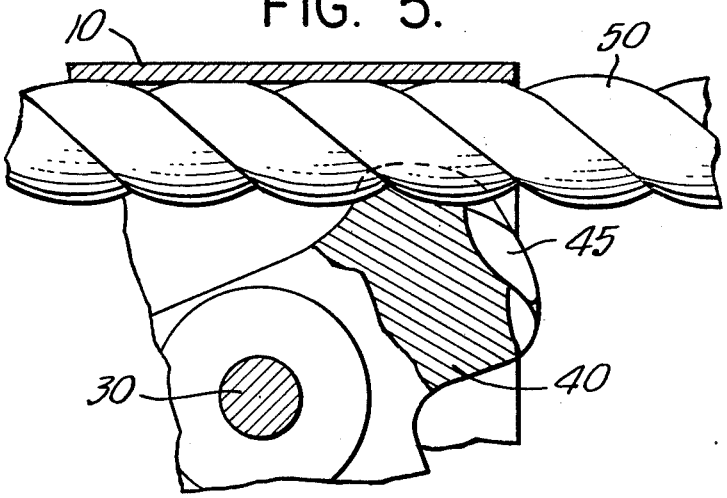
FIG. 5 is a cross sectional view of the safety grab protection device of the invention taken alone the line 5—5.

FIG. 5 shows that the cam arms 40 wedge the safety rope 50 against the bight 17 at not more than a 45° angle from the brake cam bore 25. FIG. 5 also illustrates how the contoured cam brake surfaces 45 marry the helically shaped surface of the safety rope 50 to create the braking action bond. When the cam is in the locked, contact with the rope 50 position, there is more than a single point of contact with the rope. Since the cam surface 45 mirrors the rope's shape, a large portion of the cam arm surface 45 forms a marrying surface contact with the rope 50, creating a superior bond with no sharp or potential rope cutting or damaging contact between the brake cam arm 40 and the safety line 50.

The clevis-like housing 10 and the unitary brake cam can be made of a variety of materials as long as they comply with the Fall Protection provisions of 29 C.F.R. 1926. The preferred embodiment of this invention is that the housing 10 and the brake cam 20 are constructed of aluminum.

For the purpose of giving those skilled in the art a better understanding and appreciation of the advantages of the invention the following illustrative tests were conducted on the safety grab protection device.

EXAMPLE I

A load test was applied to the safety grab protection device. This was accomplished by hanging a new ⅝ inch polypropylene rope and then attaching to it the safety grab protection device. On the cam ring of the safety grab protection device a lanyard was attached and at the other end of the lanyard a two ton come along was attached. A three ton Dinomonatur was attached to the end of the come along with the other end of the Dnomonatur being secured to the ground.

The test began at 0.0 lbs. and the weight was increased at a rate of 50 lb. load intervals until 200 lbs. was reached, at this point the rope started to stretch.

The weight was continuously increased and at 500 lbs. the reading on the Dinomonatur would vary about 75 to 100 lbs. When 1000 lbs. was reached the reading on the Dinomonatur would vary about 100 lbs. The test was concluded at 1000 lbs.

The safety grab protection device was not damaged at all. Likewise, the ⅝ inch poly rope was not damaged either. As for the lanyard it was stretched but not damaged.

EXAMPLE II

Three sample safety grab protection devices were tested for Tensile Strength in accordance with Standard Laboratory Procedure using two (2) Clevis and Pin Assemblies (⅝" Diameter Pins). The results follow in Table I:

TABLE I

| Sample | Ultimate Breaking Strength in Tension, LBS |
|---|---|
| TENZALOID | 5480 |
| 355-T6 | 6120 |
| 355 | 3640 |

The Occupational Safety and Hazard Association (OSHA) requires that all component parts have a braking strength of 5400 lbs. The data from Table I shows that the Tenzaloid and 355-T6 aluminum samples had acceptable braking strengths, while the 355 aluminum was unacceptable.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

What is claimed is:

1. A safety grab protection device operable bi-directionally for connecting a safety belt lanyard to a vertical safety rope or the like comprising:

a clevis-like housing through which a safety rope can be reeved, a unitary brake cam for disposition between the ends of said clevis-like housing, said housing being apertured through its ends and said cam having a through bore for alignment with said housing apertures, a removable pin for insertion through said apertures and said bore to pivotally join said cam to said housing, said cam having arms extending to either side of said bore normal to the axis of said bore which arms are selectively articulable about said bore as a pivot into bi-directional apposition with the bight of said housing for alternative wedging a rope against said bight, and a rope engaging intaglio formation at the ends of each said arms where said intaglio formation is a curved, knurled intaglio image of a helically intertwined safety rope.

2. A safety grab protection device as claimed in claim 1, wherein said clevis-like housing has a swallow of larger diameter than said rope.

3. A safety grab protection device as claimed in claim 2, wherein said cams are equidistant about said unitary brake cam bore to allow the free movement of said safety rope when in an unlocked position.

4. A safety grab protection device as claimed in claim 3, wherein said curved, contoured arm surface grips said safety rope against the bight of said clevis-like housing at nor more than a 45° angle from said unitary brake cam's bore.

5. A safety grab protection device as claimed in claim 4, wherein said clevis-like housing is constructed of aluminum.

6. A safety grab protection device as claimed in claim 4, wherein said unitary brake cam is constructed of aluminum.

7. A safety grab protection device operable in either direction for connecting a safety belt lanyard to a safety rope or the like comprising:

a rope housing having a generally U-shaped internal cross-section adapted to longitudinally accept a safety rope and also having opposed orificed walls, a unitary brake cam pivotally attached to said rope housing, said unitary brake cam having an orifice that is alignable with said orificed walls and also having a plurality of curved, knurled, safety rope contoured brake surfaces, each brake surface having the shape of an intaglio image of a helically intertwined safety rope and being symmetrically and quiistantly located about said orifice, said unitary brake cam also having a means of attachment to a safety belt lanyard, and a pin to pivotally fasten said unitary brake cam to said rope housing, allowing said unitary brake cam to pivot bi-directionally to allow said curve, knurled, safety rope contoured brake surfaces to form a locked position with regards to said safety rope and the inside of said rope housing.

8. A safety grab protection device as claimed in claim 7, wherein said rope housing is constructed of aluminum.

9. A safety grab protection device as claimed in claim 7, wherein said unitary brake cam is constructed of aluminum.

* * * * *